US009803608B2

(12) United States Patent
Namuduri et al.

(10) Patent No.: US 9,803,608 B2
(45) Date of Patent: Oct. 31, 2017

(54) APPARATUS AND METHOD FOR VEHICLE VOLTAGE STABILIZATION

(71) Applicant: GM GLOBAL TECHNOLOGY OPERATIONS LLC, Detroit, MI (US)

(72) Inventors: Chandra S. Namuduri, Troy, MI (US); Shawn L. Boozer, Clarkston, MI (US); Michael G. Reynolds, Troy, MI (US); Kenneth J. Shoemaker, Highland, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 840 days.

(21) Appl. No.: 14/245,746

(22) Filed: Apr. 4, 2014

(65) Prior Publication Data

US 2014/0306523 A1 Oct. 16, 2014

Related U.S. Application Data

(60) Provisional application No. 61/810,943, filed on Apr. 11, 2013.

(51) Int. Cl.
*F02N 11/08* (2006.01)

(52) U.S. Cl.
CPC ..... *F02N 11/087* (2013.01); *F02N 11/0862* (2013.01); *F02N 11/0814* (2013.01); *F02N 2250/02* (2013.01)

(58) Field of Classification Search
None
See application file for complete search history.

(56) References Cited

U.S. PATENT DOCUMENTS

2011/0140518 A1* 6/2011 Hattori ..... H02J 7/1423 307/9.1

OTHER PUBLICATIONS

U.S. Appl. No. 14/245,774, filed Apr. 4, 2014, Namuduri et al.

* cited by examiner

*Primary Examiner* — Daniel Cavallari
*Assistant Examiner* — Swarna N Chowdhuri

(57) ABSTRACT

Method for voltage stabilization during an engine starting event of a vehicle includes receiving, at a switch device module, an active Start_ON signal from a starter solenoid module indicating initiation of the engine starting event. At the switch device module, an auxiliary electrical energy storage device (ESD) is electrically coupled to one or more auxiliary loads within a predetermined delay since the active Start_ON signal was received. A primary ESD and a starter motor are electrically decoupled from the one or more auxiliary loads only after the auxiliary ESD has been electrically coupled to the one or more auxiliary loads. In response to a predetermined condition occurring while the primary ESD and the starter motor are electrically decoupled from the one or more auxiliary loads, the primary ESD and the starter motor are electrically coupled to the one or more auxiliary loads.

19 Claims, 7 Drawing Sheets

APPARATUS AND METHOD FOR VEHICLE VOLTAGE STABILIZATION

CROSS REFERENCE TO RELATED APPLICATIONS

This application claims the benefit of U.S. Provisional Application No. 61/810,943, filed on Apr. 11, 2013, which is incorporated herein by reference.

TECHNICAL FIELD

This disclosure is related to stabilizing voltage applied to loads during engine cranking events.

BACKGROUND

The statements in this section merely provide background information related to the present disclosure. Accordingly, such statements are not intended to constitute an admission of prior art.

Powertrain systems of vehicles may employ engine autostopping strategies to shutdown an engine when a vehicle is stopped. For instance, when a vehicle is stopped at a traffic light and an operator of the vehicle has a brake pedal depressed, the engine can be automatically stopped and shut down (e.g., fuel cut-off event). When vehicle motion is desired, the engine can automatically start to provide motive torque to the drive wheels. One drawback of automatically stopping and starting an engine is that electrical energy required from an energy storage device to supply a starter motor for cranking the engine can temporarily result in large voltage drops at auxiliary loads of the vehicle to which the electrical energy storage device is also supplying energy to. These voltage drops, commonly referred to as voltage sag, can result in diagnostic faults in the electrical system, controller resets and other undesirable electrical anomalies such as vehicle interior lighting flicker and accessories being interrupted.

It is known to utilize a DC-DC boost converter to boost sagging battery voltages during an autostart to supply stable voltage to certain critical loads. However, DC-DC boost converters require partitioning of all the electrical loads that are supported and are limited to low power loads, e.g., loads less than about 400 Watts. Another drawback of DC-DC converters is that higher load power leads to accelerated deterioration of battery voltage during the auto start and ineffective voltage stabilization. Additionally, DC-DC boost converter use on vehicles with higher electrical loads is cost prohibitive.

SUMMARY

Method for voltage stabilization during an engine starting event of a vehicle includes receiving, at a switch device module, an active Start_ON signal from a starter solenoid module indicating initiation of the engine starting event. At the switch device module, an auxiliary electrical energy storage device (ESD) is electrically coupled to one or more auxiliary loads within a predetermined delay since the active Start_ON signal was received. A primary ESD and a starter motor are electrically decoupled from the one or more auxiliary loads only after the auxiliary ESD has been electrically coupled to the one or more auxiliary loads. In response to a predetermined condition occurring while the primary ESD and the starter motor are electrically decoupled from the one or more auxiliary loads, the primary ESD and the starter motor are electrically coupled to the one or more auxiliary loads.

BRIEF DESCRIPTION OF THE DRAWINGS

One or more embodiments will now be described, by way of example, with reference to the accompanying drawings, in which.

DETAILED DESCRIPTION

Figure 1:
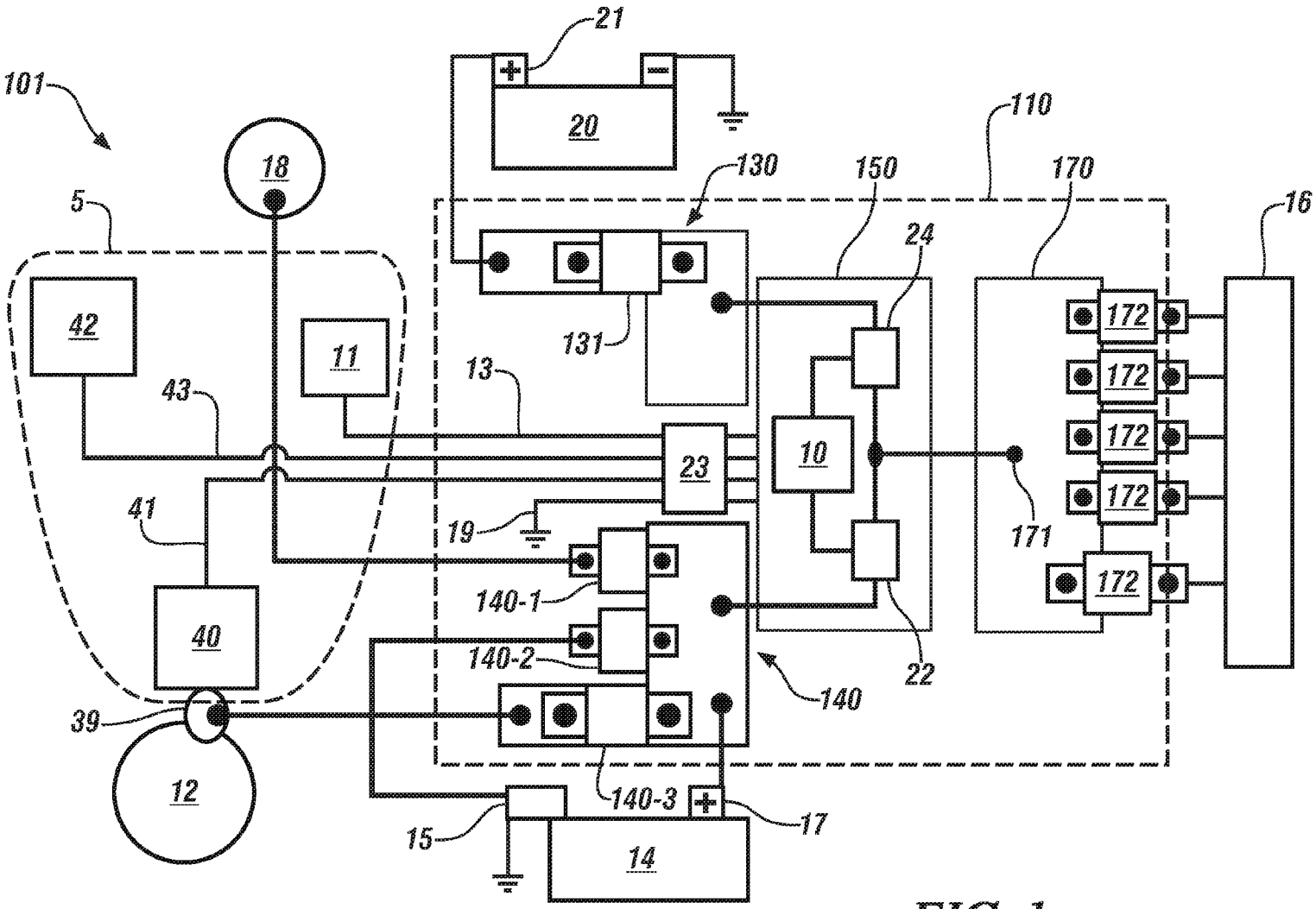
FIG. 1 illustrates an exemplary battery isolator controller utilized for voltage stabilization during engine autostart and autostop events, in accordance with the present disclosure.

Referring now to the drawings, wherein the showings are for the purpose of illustrating certain exemplary embodiments only and not for the purpose of limiting the same, FIG. 1 schematically illustrates a battery isolator controller (BIC) 101 utilized for voltage stabilization during an engine starting event for a vehicle. It will be appreciated that the BIC 101 is located within the vehicle that further includes at least an engine and a transmission. The vehicle may further include a motorized pump for providing pressured hydraulic fluid to the transmission when the engine is off. The engine starting event may correspond to either one of an engine autostart event and a key-on engine start event. As used herein, the term "engine autostart event" refers to the engine being started after the engine has been momentarily stopped and unfueled by an electronic engine control module (ECM) under specific driving conditions, such as when the vehicle is stopped at a stop light and a brake pedal is depressed. The engine autostart event can be initiated when vehicle motion is desired. As used herein, the term "key-on engine starting event" refers to the engine being started for the first time after the engine has been stopped and unfueled for an extended period of time during a key-off event. This disclosure will be directed toward the engine starting event corresponding to the engine autostart event; however, it will be understood that embodiments herein can be equally applied to the engine starting event corresponding to the key-on engine starting event. While the term "battery" is utilized, it will be appreciated that the BIC 101 is applicable to any type of energy storage device. The BIC 101 includes a battery distribution module (BDM) 110, a primary electrical energy storage device (ESD) 14, an auxiliary ESD 20, an ignition module 11, a starter motor 12, a generator 18, an electro-hydraulic transmission pump module 42, a starter solenoid module 40 and a starter solenoid 39. While the ignition, electro-hydraulic transmission pump and starter solenoid modules 11, 42, 40, respectively, are depicted as separate modules in the illustrated embodiment, it will be understood that modules 11, 42, 40 may in part, or all be, integral to an engine control module 5. The BDM 110 includes an auxiliary fuse terminal 130, a primary fuse terminal 140, a switch device module 150, and a load module 170 including a plurality of fuses 172. The load module 170 manages electrical power distribution from the primary and auxiliary ESDs 14, 20, respectively, to one or more auxiliary loads 16 of the vehicle.

The switch device module 150 of the BDM 110 includes a controller 10, a first switch device 22, and a second switch device 24. A source of the first switch device 22 is electrically coupled to a positive terminal 17 of the primary ESD 14 via the primary fuse terminal 140. The primary fuse terminal includes three fuses, wherein a first fuse 140-1 is electrically coupled to the generator 18, a second fuse 140-2 is electrically coupled to an integrated battery sensor (IBS) 15 on the primary ESD 14 and a third fuse 140-3 is electrically coupled to the starter motor 12. A drain of the first switch device 22 is electrically coupled to a positive terminal 171 of the load module 170. When the first switch device 22 is closed, the primary ESD 14 is electrically coupled to the load module 170 with a very low resistance (e.g., less than 1 milliohm). A source of the second switch device 24 is electrically coupled to the positive terminal 171 of the load module 170. A drain of the second switch device 24 is electrically coupled to a positive terminal 21 of the auxiliary ESD 20 via the auxiliary fuse terminal 130. The auxiliary fuse terminal 130 includes a first fuse 131 electrically coupled to the auxiliary ESD 20. When the second switch device 24 is closed, the auxiliary ESD 20 is electrically coupled to the load module 170.

The switch devices 22 and 24 can be solid-state power devices mounted on bus-bars serving to distribute and dissipate the heat generated by the switches when carrying electrical current. The controller 10, e.g., Logic, of the switch device module 150 can be integrated on a PC board attached in close proximity to the switch devices 22 and 24 to minimize wiring. As used herein, the term "controller" refers to a processing device. Accordingly, the terms "controller" and "processing device" will be used interchangeably herein.

Control module, module, control, controller, control unit, processor and similar terms mean any one or various combinations of one or more of Application Specific Integrated Circuit(s) (ASIC), electronic circuit(s), central processing unit(s) (preferably microprocessor(s)) and associated memory and storage (read only, programmable read only, random access, hard drive, etc.) executing one or more software or firmware programs or routines, combinational logic circuit(s), input/output circuit(s) and devices, appropriate signal conditioning and buffer circuitry, and other components to provide the described functionality. Software, firmware, programs, instructions, routines, code, algorithms and similar terms mean any instruction sets including calibrations and look-up tables. The control module has a set of control routines executed to provide the desired functions. Routines are executed, such as by a central processing unit, and are operable to monitor inputs from sensing devices and other networked control modules, and execute control and diagnostic routines to control operation of actuators. Routines may be executed at regular intervals, for example each 0.100, 1.0, 3.125, 6.25, 12.5, 25 and 100 milliseconds during ongoing engine and vehicle operation. Alternatively, routines may be executed in response to occurrence of an event.

Each of the ESDs 14 and 20 can include low voltage (e.g., 12 volts) batteries having respective negative terminals grounded, wherein, in a non-limiting exemplary embodiment, the primary ESD 14 is configured to deliver at least 70 ampere-hours and the auxiliary ESD 20 is configured of delivering around 10 ampere-hours. The primary ESD 14 is capable of providing electrical energy for multiple engine starts and standby loads during key off events over extended periods of time. Additionally, the primary ESD 14 can provide electrical energy for peak loads in excess of the generator's 18 output. The primary ESD 14 supplies electrical power to the starter motor 12 during engine starts to crank the engine. The primary ESD 14 additionally supplies electrical power to the load module during normal engine operation. As will become apparent, the primary ESD 14 and the starter motor 12 are decoupled/disconnected from the load module 170 via opening of the first switch device 22 during engine cranking events, e.g., an engine autostart. The first switch device 22 is never opened until the second switch device 24 is closed. Prior to, and during, the engine autostart event to crank the engine, the auxiliary ESD 20 is electrically coupled/connected to the load module 170 via closing of the second switch device 24. It is desirable to charge the auxiliary ESD 20 immediately after the engine autostart via maintaining the second switch device 24 closed, and to maintain a fully charged condition of the auxiliary ESD 20 by disconnecting it from the load module 170 via opening of the second switch device 24. The auxiliary ESD 20 is capable of supplying electrical energy to one or more auxiliary vehicle loads 16 during engine start events for a predetermined period of time and maintaining voltage within predetermined levels.

Opening and closing of the first and second switch devices 22, 24, respectively, is controlled based on Ignition, Start_ON, and Auto_Stop signals 13, 41, 43, respectively, provided to the controller 10 of the switch device module 150 via a signal connector 23. The controller 10, e.g., Logic, of the switch device module 150 further receives a ground signal 19. The ignition signal 13 is provided by the ignition module 11 and indicates whether the state of the vehicle is ON, e.g., a Key ON condition, or OFF, e.g., a Key OFF condition. The ignition signal 13 is active when the vehicle key-ON condition is present.

When the Start_ON signal 41 is active, the engine starting event, including either one of the engine autostart event or the key-on engine starting event, is indicated. The Start_ON signal 41 when active, is operative to close the second switch device 24 in series with the auxiliary ESD 20, and only after the second switch device 24 is closed, allow the first switch device 22 in series with the primary ESD 14 to open in case the voltage of the primary ESD 14 falls below the auxiliary ESD 20. In a non-limiting exemplary embodiment, the first switch device 22 is opened within 5 milliseconds from when the second switch device 24 has been closed. It will be appreciated that the second switch device 24 is closed within a predetermined delay since initiation of the active Start_ON signal 41. The predetermined delay can be referred to as a maximum predetermined period of time. In a non-limiting example, the predetermined delay is 2.0 milliseconds. The Start_ON signal 41 is determined from a state signal from the starter solenoid module 40. In one embodiment, the Start_ON signal 41 is active when the state signal of the starter solenoid module 40 is ON and the Start_ON signal 41 is not active when the state signal of the starter solenoid module 40 is OFF. When the Start_ON signal 41 is not active, e.g., an inactive Start_ON signal 41, the engine starting event is complete. It will be appreciated that when the state signal of the starter solenoid module 40 is OFF, the solenoid 39 of the starter motor 12 is deactivated because it is not desirable to start the engine. Likewise, when the state signal of the starter solenoid module 40 is ON, the solenoid 39 of the starter motor 12 is activated because it is desirable to start the engine. Accordingly, utilizing the state signal from the starter solenoid module 40 allows for the Start_ON signal 41 to be determined without having to obtain an additional signal from an engine control module indicating the autostart event of the engine. One having ordinary skill in the art recognizes that additional costs would be incurred if the engine control module were required to send a signal indicating the autostart event to the controller 10, e.g., Logic, of the switch device module 150.

The Auto_Stop signal 43 is determined from a state signal from the electro-hydraulic transmission pump module 42 (hereinafter "pump module 42"). It will be appreciated that when the state signal of the pump module 42 is ON, an electric motor driven pump configured to supply pressurized hydraulic fluid to a transmission of the vehicle is to be turned on when the engine is off. Accordingly, when the state signal of the pump module 42 is ON and active, the Auto_Stop signal 43 is also active to indicate an autostop of the engine. The Auto_Stop signal 43, when active, is operative to open the second switch device 24 in series with the auxiliary ESD 20. Similarly, the Auto_Stop signal 43 is not active when the state signal of the electro-hydraulic transmission pump module 42 is OFF. In vehicles not equipped with an electro-hydraulic transmission pump, and thus, not having an electrically driven pump module, the Auto_Stop signal 43 can be obtained directly from an engine control module.

Figure 2:
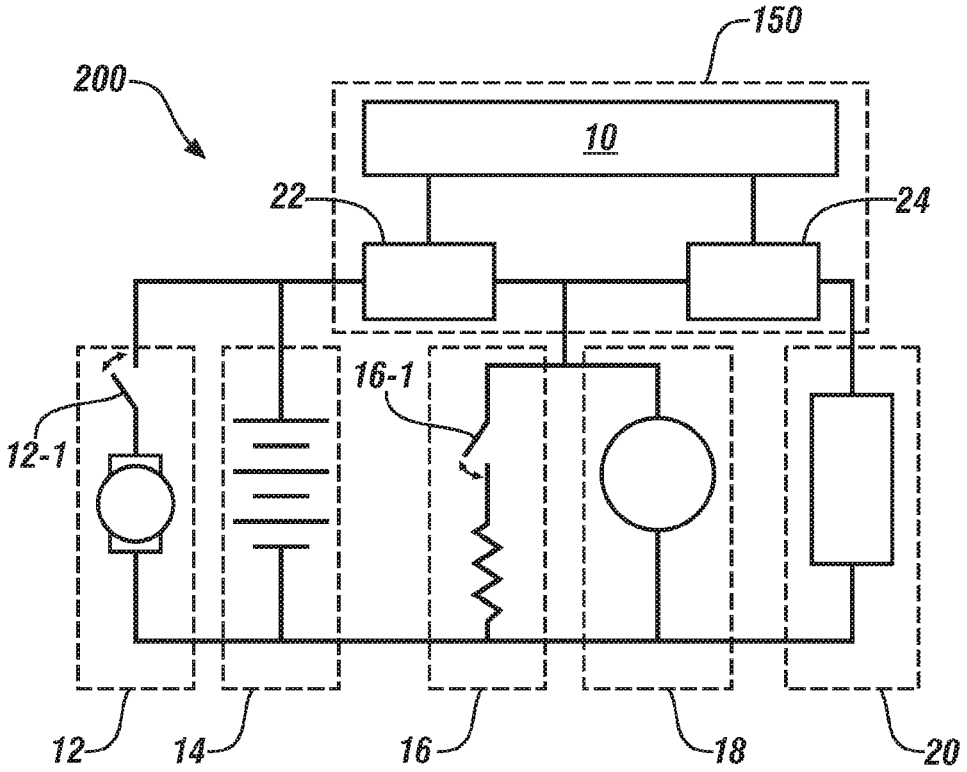
FIG. 2 illustrates an exemplary battery isolator circuit corresponding to the battery isolator controller of FIG. 1, in accordance with the present disclosure.

FIG. 2 illustrates an exemplary battery isolator circuit 200 corresponding to the battery isolator controller 101 of FIG. 1, in accordance with the present disclosure. The battery isolator circuit (IC) 200 includes the controller 10, the first switch device 22 and the second switch device 24 of the switch device module 150, and an electrical power bus including the starter motor 12, the primary ESD 14, auxiliary loads 16, the generator 18, and the auxiliary ESD 20. In the illustrated embodiment, the primary ESD 14 can be referred to as a cranking battery and the auxiliary ESD 20 can be referred to as a secondary ESD. The auxiliary loads 16 can include one or more loads of the vehicle such as, but not limited to, an air conditioning compressor, vehicle interior lighting, power seat operation, and an entertainment system. The starter motor 12 includes a solenoid switch 12-1 that is closed during engine start events, e.g., the Start_ON signal 41 is active. Each auxiliary load 16 that requires power, may include a respective switch 16-1 so that power to the one or more auxiliary loads 16 can be provided from either one of the primary and auxiliary ESDs 14, 20, respectively, based on whether the first and second switch devices 22, 24, respectively, are open or closed. The auxiliary loads requiring electrical power are normally supplied with electrical power from the generator 18 and the primary ESD 14 when the engine is ON and running within the engine's normal speed range.

Figure 3:
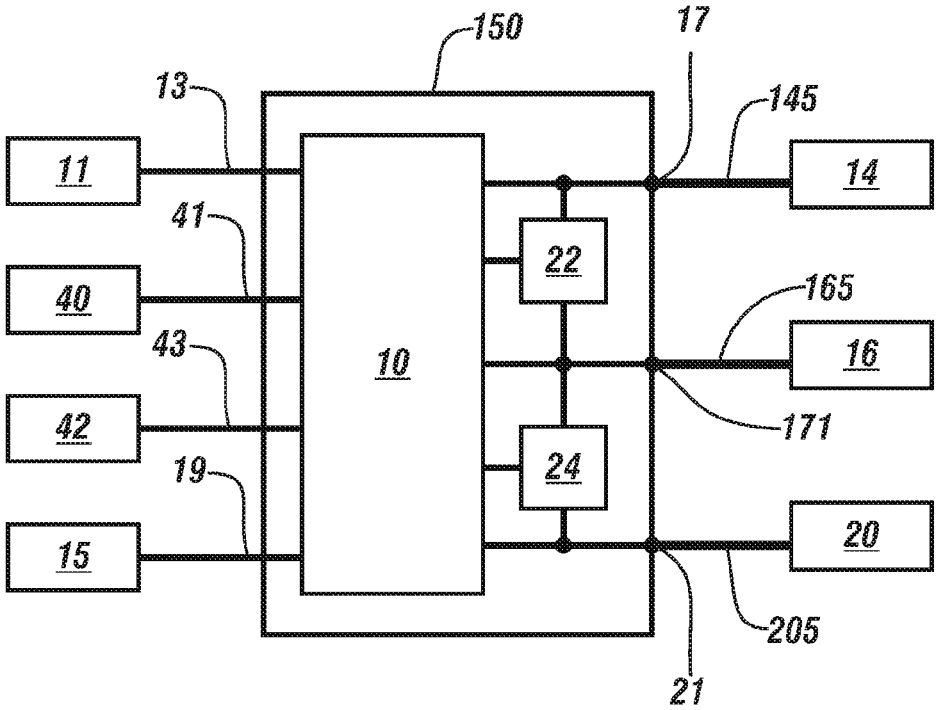
FIG. 3 illustrates input and output signals to a switch device module 150 of a battery distribution module 110 of FIG. 1, in accordance with the present disclosure.

FIG. 3 illustrates input and output signals to the switch device module 150 of the battery distribution module 110 of FIG. 1, in accordance with the present disclosure. The controller 10, e.g., logic, receives the Ignition signal 13 from the ignition module 11, the Start_ON signal 41 from the starter solenoid module 40, the Auto-Stop signal 43 from the pump module 42 and the ground signal 19 from a ground module 15. The controller 10 further monitors primary ESD voltage via signal 145 provided from the primary ESD 14, auxiliary load voltage via signal 165 provided from the one or more auxiliary loads 16 and auxiliary ESD voltage via signal 205 provided form the auxiliary ESD 20. It will be understood that each of the primary ESD 14, the one or more auxiliary loads 16 and the auxiliary ESD 20 may include integrated sensors configured to measure the corresponding voltages. It will further be understood that the load module 170 may include an integrated sensor configured to measure the corresponding voltage of the one or more auxiliary loads 16. Based on at least one of the Ignition signal 13, the Start_ON signal 41, and the Auto-Stop signal 43, opening and closing of the first and second switch devices 22, 24, respectively, is controlled. The first switch device 22 is operative to electrically couple the primary ESD 14 and a contactor of the starter motor 12 to a positive terminal of the one or more auxiliary loads 16 when closed. Specifically, the first switch device 22 when closed, electrically couples the primary ESD 14 and a contactor of the starter motor 12 to the positive terminal 171 of the load module 170, wherein the load module 170 manages electrical power distribution to the one or more auxiliary loads 16. When opened, the first switch device 22 is operative to disconnect and decouple the primary ESD 14 (and the starter motor contactor) from the one or more auxiliary loads 16.

The first switch device 22 is operative to open within a short first predetermined period of time (e.g., 10 microseconds) after the Start_ON signal 41 first went active when cranking voltage at the positive terminal of the primary ESD 14 drops by a predetermined magnitude below a monitored voltage of the auxiliary ESD 20. The controller 10 never allows the first switch device 22 to open unless the second switch device 24 is closed, wherein the second switch device 24 must be closed within a maximum predetermined period of time (e.g., predetermined delay of 2 milliseconds) upon the Start_ON signal 41 first going active and received by the controller 10. Thus, the first switch device 22 opens within the first predetermined period of time after the Start_ON signal 41 first went active and the second switch device 24 has been closed. Thereafter, the first switch device 22 remains open until one or more predetermined conditions have occurred. In one embodiment, the predetermined condition occurs, and the first switch device 22 is transitioned to close, in response to the voltage of the primary ESD 14 exceeding the voltage of the one or more auxiliary loads 16 by a predetermined magnitude. In another embodiment, the predetermined condition occurs, and the first switch device 22 is transitioned to close, in response to a second predetermined period of time has elapsed from when the Start_ON signal 41 went active. In this embodiment, the second predetermined period of time must elapse even if the voltage of the primary ESD 14 has exceeded the voltage of the one or more auxiliary loads 16 by the predetermined magnitude prior to the second predetermined period of time elapsing. In yet another embodiment, the predetermined condition occurs, and the first switch device 22 is transitioned to close, in response to the Start_ON signal 41 no longer being active, e.g., inactive. The inactive Start_ON signal 41 indicates completion of the engine starting event. Embodiments herein are directed toward having the first switch device 22 self bias on current draws greater than 5 amps and remain unbiased for current draws less than 100 milliamps. The second switch device 24 is operative to electrically couple the auxiliary ESD 20 to the positive terminal (e.g, positive terminal 171 of load module 170) of the one or more auxiliary loads 16 when closed.

As aforementioned, the second switch device 24 must be closed within the predetermined delay (also referred to as the "maximum predetermined period of time") after the Start_ON signal 41 goes active. It will be appreciated that in response to the Start_ON signal 41 going active, there is a time delay associated with actuating the starter control solenoid 39, wherein the time delay of the starter control solenoid 39 closing the contactor of the starter motor 12 exceeds the predetermined delay. Accordingly, the second switch device 24 must be closed within the predetermined delay to electrically couple the auxiliary ESD 20 with the one or more auxiliary loads 16 prior to the starter control solenoid 39 being activated. In a non-limiting example, the predetermined delay is 2 milliseconds. When opened, the second switch device 24 is operative to disconnect and decouple the auxiliary ESD 20 from the one or more auxiliary loads 16. The second switch device 24 may transition from closed to opened when either one of the Auto_Stop signal 43 is active, the Ignition signal 13 is inactive or a predetermined inactive period of time has elapsed since the Start_ON signal 41 has gone inactive. It will be appreciated that the inactive Ignition signal 13 indicates the Key OFF condition wherein the state of the vehicle is OFF and the inactive Start_ON signal indicates initiation of an engine autostop event.

Figure 4:
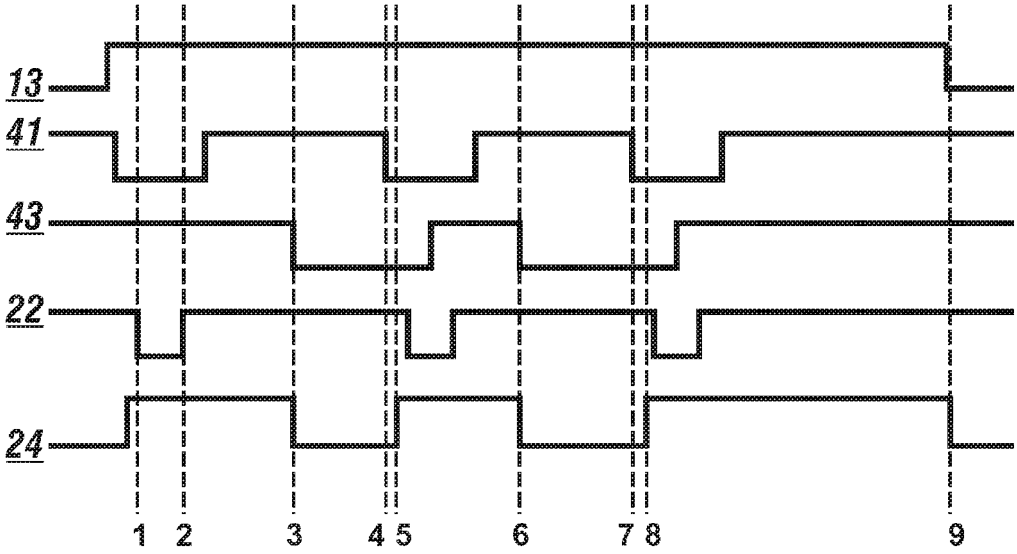
FIG. 4 illustrates a first non-limiting logic of opening and closing responses of first and second switch devices of the switch device module 150 of FIG. 3 through a plurality of autostart and autostop events, in accordance with the present disclosure.

FIG. 4 illustrates a first non-limiting logic of opening and closing time responses of the first and second switch devices 22, 24, respectively, of FIG. 3 through a plurality of autostart and autostop events, in accordance with the present disclosure. Each of the ignition signal 13, the Start_ON signal 41, the Auto_Stop Signal 43, the first switch device signal 22 and the second switch device signal 24 are bi-level signals operative at either one of a low level and a high level. With respect to the ignition signal 13, a low level indicates the ignition signal 13 is not active corresponding to a vehicle Key OFF condition and a high level indicates the ignition signal 13 is active corresponding to a vehicle Key ON condition. With respect to the Start_ON signal 41, a high level indicates the Start_ON signal 41 is not active corresponding to no engine autostart event and a low level indicates the Start_ON signal 41 is active corresponding to an engine autostart event. With respect to the Auto_Stop signal 43, a high level indicates the Auto_Stop signal 43 is not active corresponding to no autostop event and a low level indicates the Auto_Stop signal 43 is active corresponding to an autostop event of the engine. With respect to the switches 22 and 24, high levels indicate the switches 22 and 24 are closed and low levels indicate the switches 22 and 24 are open. Dashed vertical lines 1-9 indicate various time events.

When the ignition signal 13 is inactive and the vehicle is in a Key OFF condition, the first switch device 22 is kept closed so that the primary ESD 14 is electrically connected to the one or more auxiliary loads 16. The first switch device 22 remains closed until an engine cranking event indicated by an active Start_ON signal 41 is received by the controller 10. Specifically, the first switch device 22 is opened at dashed vertical line 1, the first predetermined period of time after the Start_ON signal 41 first became active, e.g., the autostart event of the engine is initiated. It will be understood that initiation of the autostart event indicates initiation of the engine cranking event. Further, the first switch device 22 only opens within a predetermined period of time after the second switch device 24 has been closed. The second switch device 24 is closed, prior to dashed vertical line 1, when both the ignition signal 13 is active and the Start_ON signal 41 is active. Specifically, the second switch device 24 must be closed within the predetermined delay after the Start_ON signal 13 goes active. In a non-limiting example, the predetermined delay is 2 milliseconds. For instance, the Start_ON signal 41 goes active at dashed vertical line 4 and the second switch device 24 is closed at dashed vertical line 5, wherein the predetermined delay is represented by the period of time between dashed vertical lines 4 and 5. Further, the first switch device 22 is opened after dashed vertical line 5 after the second switch device 24 has been closed. Similarly, the Start_ON signal 41 goes active at dashed vertical line 7 and the second switch device 24 is closed at dashed vertical line 8, wherein the predetermined delay is represented by the period of time between dashed vertical lines 7 and 8. Further, the first switch device 22 is opened after dashed vertical line 8 after the second switch device 24 has been closed which is no later than the closing of the contactor of the starter motor 12.

Further embodiments may include opening the first switch device 22 when both the Ignition signal 13 is active and voltage of the primary ESD 14 is less than voltage of the one or more auxiliary loads 16 by a second predetermined magnitude of voltage. In a non-limiting example, the predetermined magnitude of voltage is 50 mV. The predetermined magnitude of voltage associated with opening the first switch device 22 can include a different value than that of the predetermined magnitude of voltage associated with the predetermined condition for closing the first switch device 22. The second switch device 24 must be closed by the controller 10 prior to opening the first switch device 22. As aforementioned, the first switch device 22 remains opened unless one or more of the predetermined conditions are met and the engine has been started. In the illustrated logic of FIG. 4, the first switch device 22 is opened at dashed vertical line 1 when both the ignition signal 13 is active and voltage of the primary ESD 14 is less than the voltage of the one or more auxiliary loads by the predetermined magnitude of voltage and the first switch device 22 is closed after the engine is started and at least one of the predetermined conditions is met at dashed vertical line 2.

Embodiments of the logic of FIG. 4 are further directed toward opening the second switch device 24 when either the Auto_Stop signal 43 is active or the Ignition signal 13 is not active. For instance, at each of dashed vertical lines 3 and 6, the second switch device 24 is opened when the Auto_Stop signal 43 goes active. Likewise, the second switch device 24 is opened when the Ignition signal 13 is no longer active at dashed vertical line 9.

Figure 5:
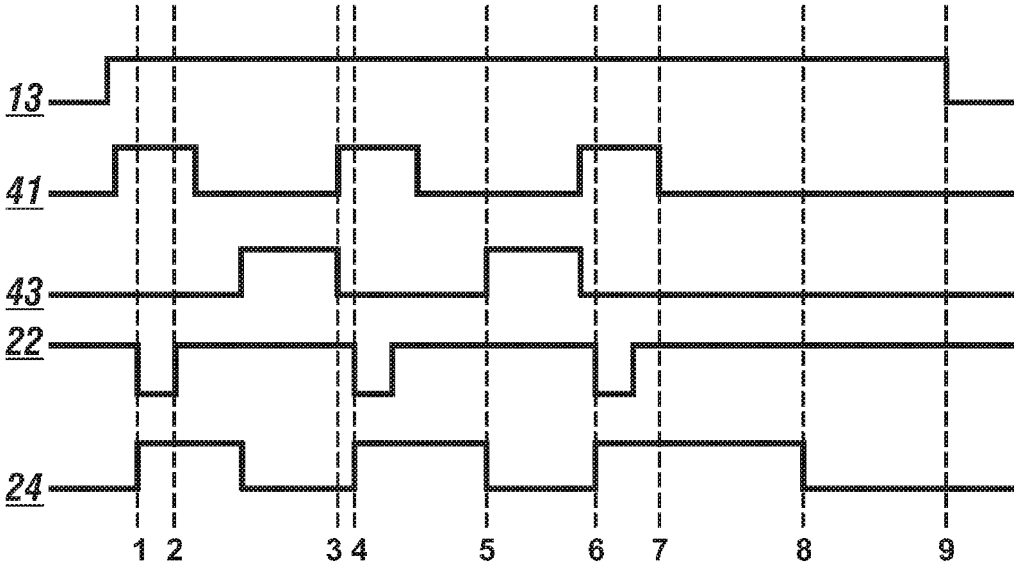
FIG. 5 illustrates a second non-limiting logic of opening and closing responses of first and second switch devices of the switch device module 150 of FIG. 3 through a plurality of autostart and autostop events, in accordance with the present disclosure.

FIG. 5 illustrates a second non-limiting logic of opening and closing time responses of the first and second switch devices 22, 24, respectively, of FIG. 3 through a plurality of autostart and autostop events, in accordance with the present disclosure. Each of the ignition signal 13, the Start_ON signal 41, the Auto_Stop Signal 43, the first switch device signal 22 and the second switch device signal 24 are bi-level signals operative at either one of a low level and a high level. With respect to the Ignition signal 13, a low level indicates the ignition signal 13 is not active corresponding to a vehicle Key OFF condition and a high level indicates the ignition signal 13 is active corresponding to a vehicle Key ON condition. With respect to the Start_ON signal 41, a high level indicates the Start_ON signal 41 is active corresponding to an engine autostart event and a low level indicates the Start_ON signal 41 is not active corresponding to no engine autostart event. With respect to the Auto_Stop signal 43, a low level indicates the Auto_Stop signal 43 is not active corresponding to no autostop event and a high level indicates the Auto_Stop signal 43 is active corresponding to an autostop event of the engine. With respect to the switches 22 and 24, high levels indicate the switches 22 and 24 are closed and low levels indicate the switches 22 and 24 are open. Dashed vertical lines 1-8 indicate various time events.

In the non-limiting logic of FIG. 5, the first switch device 22 is normally kept closed when the Ignition signal 13 is inactive or transitions from inactive to active. In response to the Start_ON signal 41 going active, the second switch device 24 is closed just prior to dashed vertical line 1 within the predetermined delay (e.g., 2 milliseconds). The first switch device 22 is operative to open within the short first predetermined period of time (e.g., 10 microseconds) after the Start_ON signal 41 first going active when cranking voltage applied to the positive terminal of the primary ESD 14 drops by the predetermined magnitude of voltage below that of the one or more auxiliary loads 16. It will be understood that the controller 10 of FIG. 3 is operative to only permit the first switch device 22 to open after the second switch device 24 has been closed. In the illustrated embodiment, the first switch device 22 opens at dashed vertical line 1 the short first predetermined period of time after the Start_ON signal 41 went active and the second switch device 22 has been closed. Likewise, the first switch device 22 opens at dashed vertical line 4, the short first predetermined period of time after the Start_ON signal 41 went active at dashed vertical line 3 and the second switch device 22 has been closed prior to dashed vertical line 4. Similarly, the first switch device 22 opens at dashed vertical line 6, the short first predetermined period of time after the Start_ON signal 41 went active and the second switch device 24 has been closed prior to dashed vertical line 6.

The first switch device 22 remains open until one or more of the predetermined conditions are met. In the illustrated embodiment, the first switch device 22 is transitioned to close at dashed vertical line 2 when one or more of the predetermined conditions are met. In one embodiment, the first switch device 22 is transitioned to close at dashed vertical line 2 when the voltage of the primary ESD 14 exceeds the voltage of the one or more auxiliary loads 16 by the predetermined magnitude. In another embodiment, the first switch device 22 is transitioned to close at dashed vertical line 2 after the predetermined period of time has elapsed since initiation of the active Start_ON signal 41. In this embodiment, even if the voltage of the primary ESD 14 exceeds the voltage of the one or more auxiliary loads by the predetermined magnitude, the first switch device 22 will not transition to close until the second redetermined period of time has elapsed. In yet another embodiment, the first switch device 22 may remain open until the Start_ON signal 41 goes inactive. The inactive Start_ON signal 41 indicates completion of the engine starting event.

Embodiments of the logic of FIG. 5 are further directed toward the second switch device 24 closing within the predetermined delay after the Start_ON signal 41 goes active. For instance, the Start_ON signal 41 goes active at dashed vertical line 3 and the second switch device 24 is closed just prior to dashed vertical line 4, wherein the predetermined delay is between dashed vertical line 3 and just prior to dashed vertical line 4. In a non-limiting embodiment, the predetermined delay between dashed vertical line 3 and just prior to dashed vertical line 4 is equal to 2 milliseconds. Moreover, the second switch device 24 is opened based on the earlier one of the Ignition signal 13 going inactive, the Auto_Stop signal 43 becoming active and the predetermined period of time elapsing since the Start_ON signal 13 has gone inactive. Allowing the second switch device 24 to remain closed after the Start_ON signal 41 has become inactive for the predetermined period of time, allows the auxiliary ESD 20 to be fully charged from the now fueled and running engine after being partially depleted from supplying electrical energy to the one or more auxiliary loads 16 during the engine cranking. However, it is desirable to open the second switch device 24 upon being charged so that the auxiliary ESD 20 remains in a fully charged condition so that electrical energy can be supplied to the one or more auxiliary loads 16 during subsequent autostart events of the engine. In the illustrated embodiment of FIG. 5, the second switch device 24 is closed just prior to dashed vertical line 4, and thus, the closing occurs within the predetermined delay after the Start_ON signal goes active at dashed vertical line 3. The second switch device 24 remains closed until the Auto_Stop signal 43 goes active at dashed vertical line 5. Furthermore, the second switch device 24 is closed just prior to dashed vertical line 6, within the predetermined delay after the Start_ON signal 41 goes active. The second switch device 24 remains closed for the predetermined period of time from when the Start_ON signal 41 goes inactive at dashed vertical line 7 until opening at dashed vertical line 8, wherein the predetermined period of time from when the Start_ON signal 41 went inactive is between dashed vertical lines 7 and 8.

Figure 6:
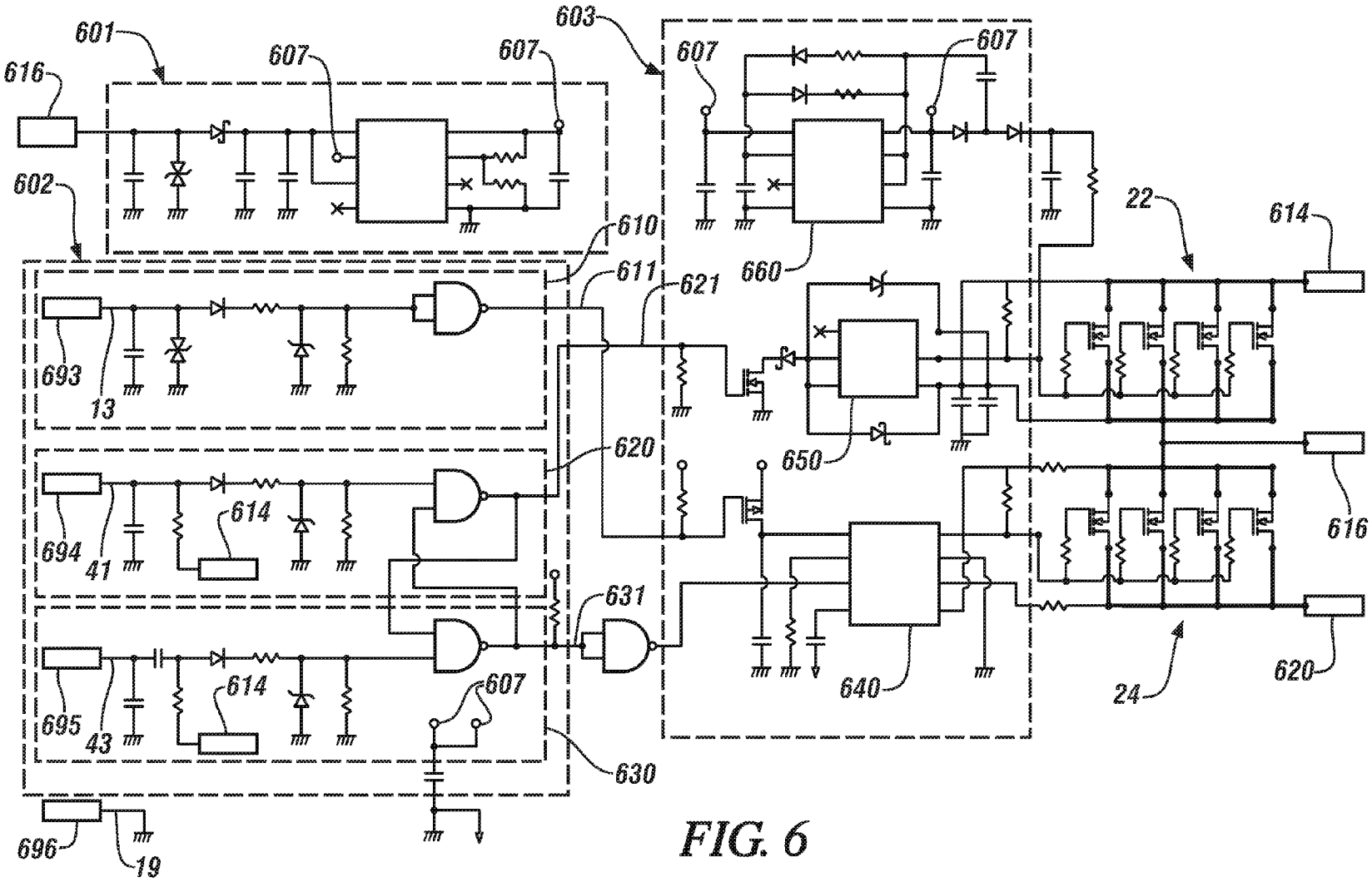
FIG. 6 illustrates an exemplary schematic of the switch device module 150 of FIG. 3 including a bias power supply circuit 601, a switch control logic circuit 602, and a driver circuit 603, in accordance with the present disclosure.

FIG. 6 illustrates a non-limiting exemplary schematic of the switch device module 150 of FIG. 3 including a bias power supply circuit 601, a switch control logic circuit 602 and a driver circuit 603, in accordance with the present disclosure. The circuits 601-603 variously include diodes, zener diodes, resistors, amplifiers, capacitors, gates, ground and meters each depicted by their corresponding schematic symbol for common electronics. The bias power supply circuit 601 draws power from terminal 616 corresponding to the auxiliary loads 16. The bias power supply circuit 601 includes input filtering, overvoltage, reverse voltage protection and supplies a predetermined regulated voltage (e.g., 10 to 12V) via terminal 607 to the switch control logic and driver circuits 602, 603, respectively. The switch control logic circuit 602 conditions and processes the input Ignition signal 13 from ignition terminal 693 corresponding to the ignition module 11 within Ignition signal sub-circuit 610, the input Start_ON signal 41 from starter terminal 694 corresponding to the starter solenoid module 40 within a Start_ON signal sub-circuit 620 and the input Auto_Stop signal 43 from pump terminal 695 corresponding to the pump module 42 within an Auto-Stop signal sub-circuit 630 to generate necessary signals 611, 621 and 631 to the driver circuit 603 to control the switches 22 and 24. A ground terminal 696 is further depicted that includes the ground signal 19. Sub-circuits 620 and 630 each include terminal 614 indicating a voltage corresponding to the primary ESD 14.

The driver circuit 603 includes a charge pump circuit 660 configured to keep the first switch device 22 closed. As aforementioned, the first switch device 22 can be opened, subsequent to closing the second switch device 24, when the voltage of the primary ESD 14 becomes less than the voltage of the one or more auxiliary loads by the predetermined magnitude and the Start_ON signal 41 is active. In the illustrated embodiment, drive control signals 621 and 631 are derived from the Start_ON signal 41 and the Auto_Stop signal 43. Signal 621 enables opening of the first switch 22 within the first predetermined period of time when the voltage at terminal 614 corresponding to the primary ESD 14 falls below that of terminal 616 corresponding to the auxiliary loads 16 by the predetermined magnitude when the Start_ON signal 41 is active. Signal 631 enables closing of second switch 24 within the predetermined delay from the instant the Start_ON signal 41 became active and prior to opening of the first switch 22. The driver circuit 603 includes a first switch device charge pump/comparator circuit 650 configured to open the first switch device 22 via discharging gates of the first switch device 22 when the voltage at terminal 614 falls below that of terminal 616 by the second predetermined magnitude of voltage corresponding to the voltage of the primary ESD 14 becoming less than the voltage of the one or more auxiliary loads 16 by the predetermine magnitude of voltage. The driver circuit 603 further includes a second switch device charge pump/comparator circuit 640 configured to open and close the second switch device 24 via discharging/charging gates of the second switch device 24.

The first switch device 22 includes a single or plurality of metal-oxide-semiconductor field-effect transistors (MOSFETs) connected to in parallel, each having a respective gate resistor. A source of each MOSFET of the first switch device 22 is electrically coupled to the primary ESD 14 via terminal 614 and a drain of each MOSFET of the first switch device 22 is electrically coupled to the one or more auxiliary loads 16 via terminal 616. The first switch device 22 can be transitioned between open and closed states based on a voltage received from the first switch device charge pump/comparator circuit 650 configured to open the gates of the first switch device 22 under previously described conditions. The second switch device 24 includes a single or plurality of MOSFETs connected to in parallel, each having a respective gate resistor. A source of each MOSFET of the second switch device 24 is electrically coupled to the one or more auxiliary loads 16 via terminal 716 and a drain of each MOSFET of the second switch device 24 is electrically coupled to the auxiliary ESD 20 via terminal 620. The second switch device 24 can be transitioned between open and closed states based on a voltage boost received from second switch device charge pump/comparator circuit 640 to open and close the second switch device 24 using the control signal 631 derived from the Start_ON, and Auto_Stop signals, as previously described above in the exemplary embodiment of FIG. 3. In this embodiment, the Ignition (Run/Crank) signal when OFF, interrupts power to second switch device charge pump/comparator circuit 640 to turn-off the second switch device 24.

Figure 7:
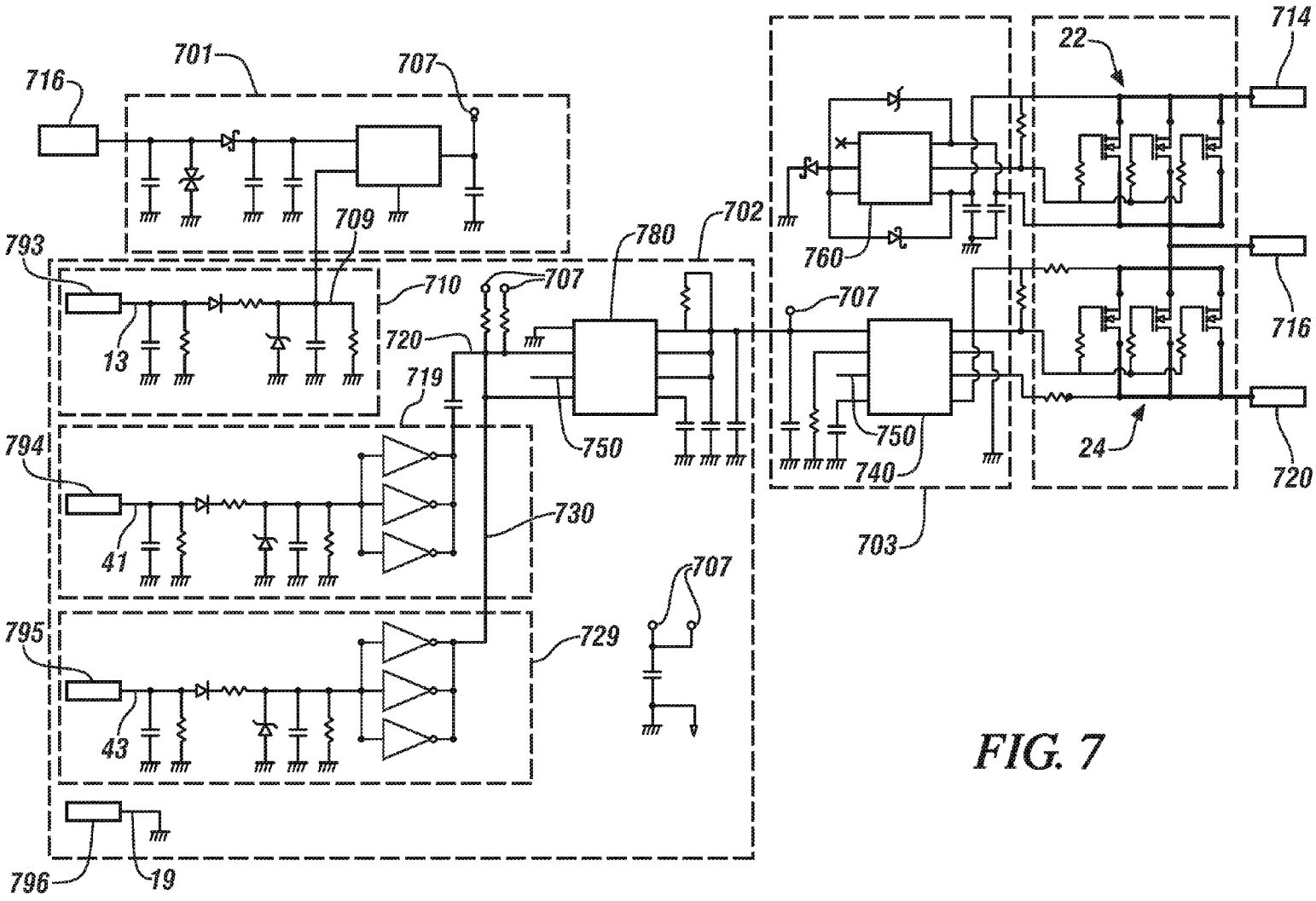
FIG. 7 illustrates another exemplary schematic of the switch device module 150 of FIG. 3 including a bias control circuit 701, a switch control logic circuit 702, and a driver circuit 703, in accordance with the present disclosure.

FIG. 7 illustrates a non-limiting exemplary schematic of the switch device module 150 of FIG. 3 including a bias control circuit 701, a switch control logic circuit 702 and a driver circuit 703, in accordance with the present disclosure. The circuits 701-703 variously include diodes, zener diodes, resistors, amplifiers, capacitors, gates and meters each depicted by their corresponding schematic symbol for common electronics. The bias power supply circuit 701 draws power from terminal 716 corresponding to the auxiliary loads 16. The power supply circuit 701 includes input filtering, overvoltage, reverse voltage protection and supplies a predetermined regulated voltage (e.g., 10 to 12V) via terminal 707 to the switch control logic and driver circuits 702, 703, respectively, when the Ignition signal 13 is ON and active. The switch control logic circuit 702 conditions and processes the input Ignition signal 13 from terminal 793 corresponding to the ignition module 11 within an Ignition sub-circuit 710, the input Start_ON signal 41 from terminal 794 corresponding to the starter solenoid module 40 within a Start_ON sub-circuit 719 and the input Auto_Stop signal 43 from terminal 795 corresponding to the pump module 42 within an Auto_Stop sub-circuit 729 to generate necessary signals 709, 720 and 730. Signal 709 turns off power to a second switch device charge pump/comparator circuit 740 of the second switch device 24 when the Ignition is OFF or inactive. Signals 720 and 730 mark the events when the Start_ON and Auto_Stop signals go active or inactive which are provided to a timer circuit 780 to generate a control signal 750 to the second switch device charge pump/comparator circuit 740 per the logic described above with reference to the non-limiting exemplary second logic of FIG. 5. Switch control logic circuit 702 further includes ground terminal 796 and the ground signal 19.

The driver circuit 703 further includes a first switch device charge pump/comparator circuit 760 configured to keep the first switch device 22 normally closed. As aforementioned, the first switch device 22 can be opened, subsequent to closing the second switch device 24, when the voltage of the primary ESD 14 denoted by terminal 714 becomes less than the voltage of the one or more auxiliary loads 16 denoted by terminal 716 by the predetermined magnitude and the Start_ON and Ignition signals are active. In the illustrated embodiment, the Start_ON signal can be provided by the Start_ON event signal 720. The second switch device charge pump circuit 740 is configured to open and close the second switch device 24 via discharging/charging gates of the second switch device 24. Terminal 720 denotes the auxiliary ESD 20.

The first switch device 22 includes a single or plurality of MOSFETs connected to in parallel, each having a respective resistor. A source of each MOSFET of the first switch device 22 is electrically coupled to the primary ESD 14 via terminal 714 and a drain of each MOSFET of the first switch device 22 is electrically coupled to the one or more auxiliary loads 16 via terminal 716. The first switch device 22 can be transitioned between open and closed states based on a voltage received from first charge pump/comparator circuit 760 to open the first switch device 22. The second switch device 24 includes a single or plurality of MOSFETs connected to in parallel, each having a respective gate resistor. A source of each MOSFET of the second switch device 24 is electrically coupled to the one or more auxiliary loads 16 via terminal 716 and a drain of each MOSFET of the second switch device 24 is electrically coupled to the auxiliary ESD 20 via terminal 720. The second switch device 24 can be transitioned between open and closed states based on a voltage received from the second switch device charge pump/comparator circuit 740 to open and close the second switch device 24.

Figure 8:
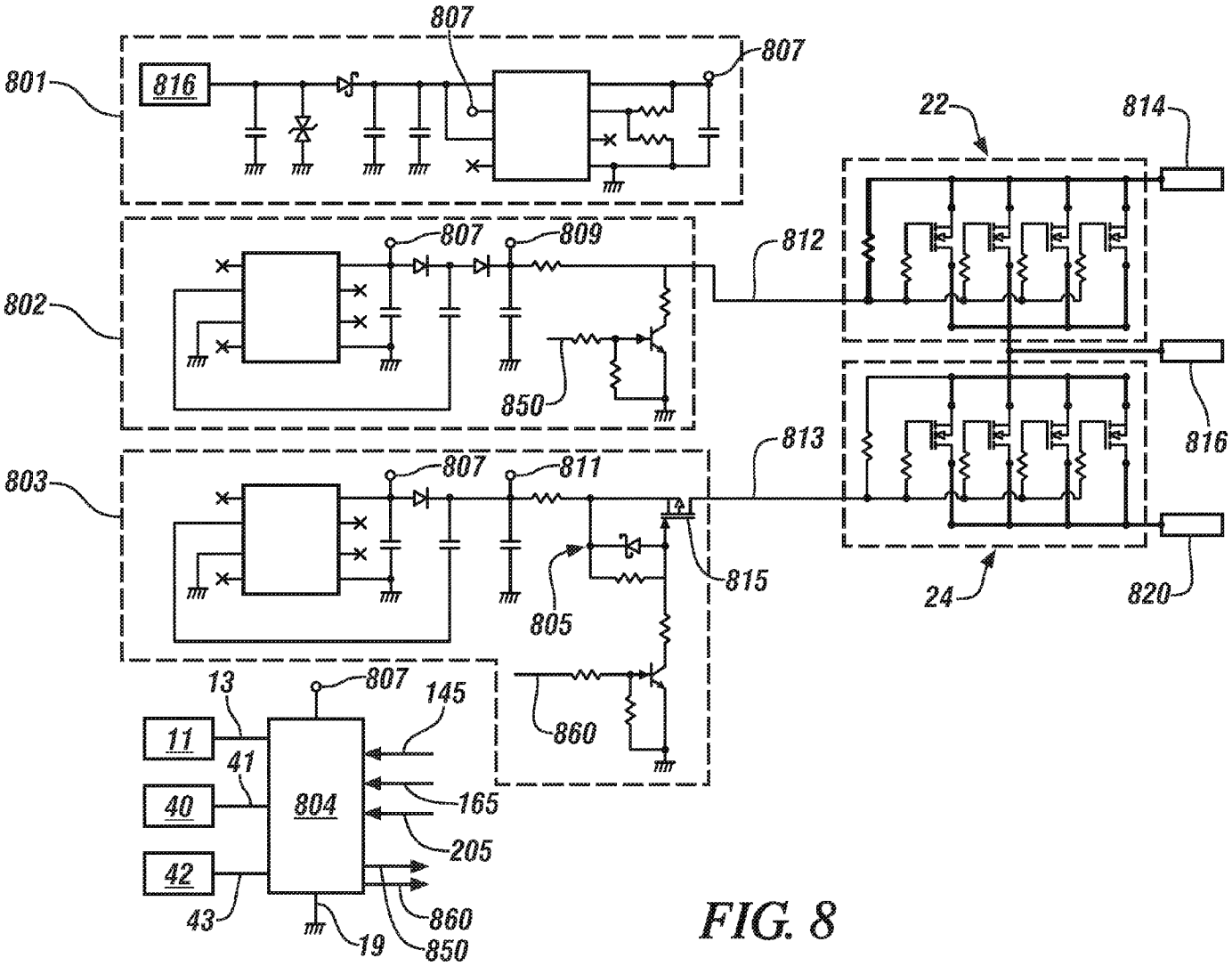
FIG. 8 illustrates another exemplary schematic of the switch device module 150 of FIG. 3, including a bias control circuit 801, a first switch device charge pump/driver circuit 802, a second switch device charge pump/driver circuit 803, and a controller 804, in accordance with the present disclosure.

FIG. 8 illustrates a non-limiting exemplary schematic of the switch device module 150 of FIG. 3, including a bias control circuit 801, a first switch device charge pump/driver circuit 802, a second switch device charge pump/driver circuit 803 and a controller 804, in accordance with the present disclosure. The circuits 801-803 variously include diodes, zener diodes, resistors, amplifiers, capacitors, gates, ground and meters each depicted by their corresponding schematic symbol for common electronics. The bias power supply circuit 801 draws power from terminal 816 corresponding to the auxiliary loads 16. The bias power supply circuit includes input filtering, reverse voltage protection and supplies a predetermined regulated voltage(s) (e.g., 5V, 12V) from terminals 807 to the first and second switch device charge pump/driver circuits 802, 803, respectively. In the illustrated embodiment, the controller 804 is a processing device and corresponds to the controller 10 of FIGS. 1 and 3.

The first switch device charge pump/driver circuit 802 is configured to keep the first switch device 22 normally closed via an output voltage from terminal 809 of the charge pump/driver circuit 802. As aforementioned, the first switch device 22 can be opened using an active signal 850 output from the controller 804, subsequent to closing the second switch device 24, when the voltage of the primary ESD 14 becomes less than the voltage of the one or more auxiliary loads 16 by the predetermined magnitude and the Start_ON signal 41 is active. For instance, the controller 804 outputs the active signal 850 to restrict the output voltage from terminal 809 from closing the first switch device 22, thereby causing the first switch device 22 to open when the voltage of the primary ESD 14 becomes less than the voltage of the one or more auxiliary loads 16 by the predetermined magnitude and the Start_ON signal 41 is active. In the illustrated embodiment, the Start_ON signal 41 can be provided to the controller 804. The second switch device charge pump/driver circuit 803 is configured to open and close the second switch device 24 via opening/closing gates of the second switch device 24 through a pass switch circuit 805 controlled by the switch control logic of the controller 804 via signal 860 output from the controller 804. In the illustrated embodiment, a pass switch 815 of the pass switch circuit 805 is kept open when signal 860 is inactive to restrict an output voltage from terminal 811 of the charge pump/driver circuit 803 from closing the gates of the second switch device 24. When signal 860 is active, the pass switch 815 is closed to allow the output voltage from terminal 811 to close the gates of the second switch device 24, causing the second switch device 24 to close.

The first switch device 22 includes a single or plurality of MOSFETs connected to in parallel, each having a respective gate resistor. A source of each MOSFET of the first switch device 22 is electrically coupled to the primary ESD 14 via terminal 814 and a drain of each MOSFET of the first switch device 22 is electrically coupled to the one or more auxiliary loads 16 via terminal 814. The first switch device 22 can be transitioned between open and closed states based on a voltage signal 812 received from the first switch device charge pump/driver circuit 802 to open the first switch device 22 when signal 850 is active. The second switch device 24 includes a single or plurality of MOSFETs connected to in parallel, each having a respective gate resistor. A source of each MOSFET of the second switch device 24 is electrically coupled to the one or more auxiliary loads 16 via terminal 816 and a drain of each MOSFET of the second switch device 24 is electrically coupled to the auxiliary ESD 20 via terminal 820. The second switch device 24 can be transitioned between open and closed states based on a voltage boost signal 813 received from the second switch device charge pump/driver circuit 803. For instance, the voltage boost signal 813 will close the second switch device 24 when the signal 860 output from the controller 804 is active and the voltage boost signal 813 will open the second switch device 24 when the signal 860 is inactive.

The controller 804, as described above with reference to the controller 10 of FIG. 3, receives the Ignition signal 13 from the ignition module 11, the Start_ON signal 41 from the starter solenoid module 40, and the Auto-Stop signal 43 from the pump module 42. The controller 804 is configured to command, via the active signal 850, the first switch device charge pump/driver circuit 802 to open the first switch device 22 within a short first predetermined period of time (e.g., 10 microseconds) when cranking voltage (e.g., ESD voltage 145) applied to the positive terminal of the primary ESD 14 drops by a first predetermined magnitude below that of the auxiliary load voltage 165. The first switch device 22 opens within a predetermined period of time after the second switch device 24 has been closed, wherein the controller 804 commands, via the active signal 860, the second switch device charge pump/driver circuit 803 to close the second switch device 24 within the predetermined delay (e.g., the maximum predetermined period of time of 2 milliseconds) upon the Start_ON signal 41 going active. Thereafter, the first switch device 22 remains open until the one or more predetermined conditions described above have been met. The controller 804 commands, via the inactive signal 860, the second switch device 24 to be opened through the voltage boost signal 813 of the driver circuit 803 using a combination of the Auto_Stop active, Starter_ON inactive or Ignition inactive signals 43, 41, 13, respectively, and other predetermined conditions previously described have been met.

Figure 9:
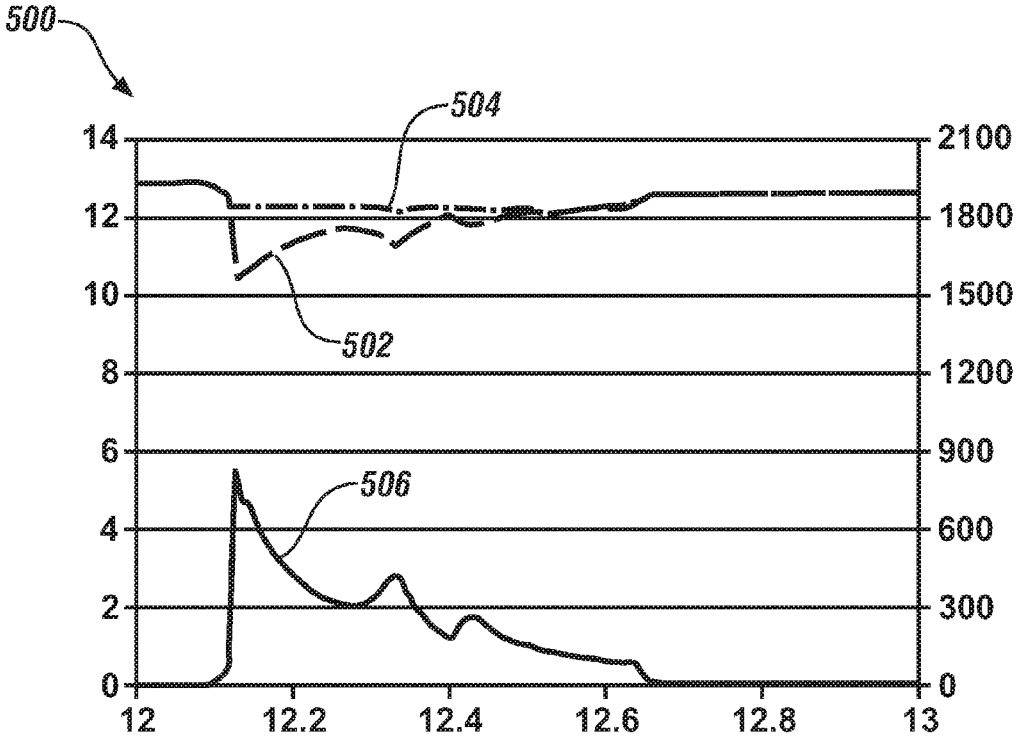
FIG. 9 illustrates an exemplary plot 500 of cranking voltage 502, load voltage 504, and current 506 during an engine cranking event utilizing the exemplary battery isolator circuit 200 of FIG. 2, in accordance with the present disclosure.

FIG. 9 illustrates an exemplary plot 500 of cranking voltage 502, load voltage 504, and current 506 during an engine cranking event utilizing the exemplary battery isolator circuit of FIG. 2, in accordance with the present disclosure. It will be understood that voltage is supplied from the primary ESD 14 during an autostart of the engine to supply energy required for cranking the engine. Accordingly, current is drawn from the primary ESD 14 during cranking of the engine.

The horizontal x-axis of plot 500 denotes time in seconds, the left-side vertical y-axis denotes voltage in Volts, and the right-side vertical y-axis denotes current in Amps. In response to an engine cranking event at around 12.1 seconds, the cranking voltage 502 drops from about 13 Volts to less than 11 Voltas and the current 506 drawn increases to about 890 Amps from zero Amps. As engine starting occurs, the current 506 begins to decrease back to zero Amps and the cranking voltage 502 begins to increase back to about 13 Volts. It will be appreciated that the load voltage 504 does not experience a significant voltage drop because the first switch device 22 is opened during the engine cranking event to disconnect the starter motor 12 and the primary ESD 14 from the one or more auxiliary loads 16 and the second switch device 24 is closed to electrically couple the auxiliary ESD 20 to the one or more auxiliary loads 16 prior to opening of the first switch device 22. Accordingly, the auxiliary ESD 20 is supplying energy to the one or more auxiliary loads 16 during the engine cranking event. Due to the disconnection between the starter motor 12 and the primary ESD 14 from the one or more auxiliary loads 16, the voltage load 504 does not experience a voltage drop during the engine cranking.

Figure 10:
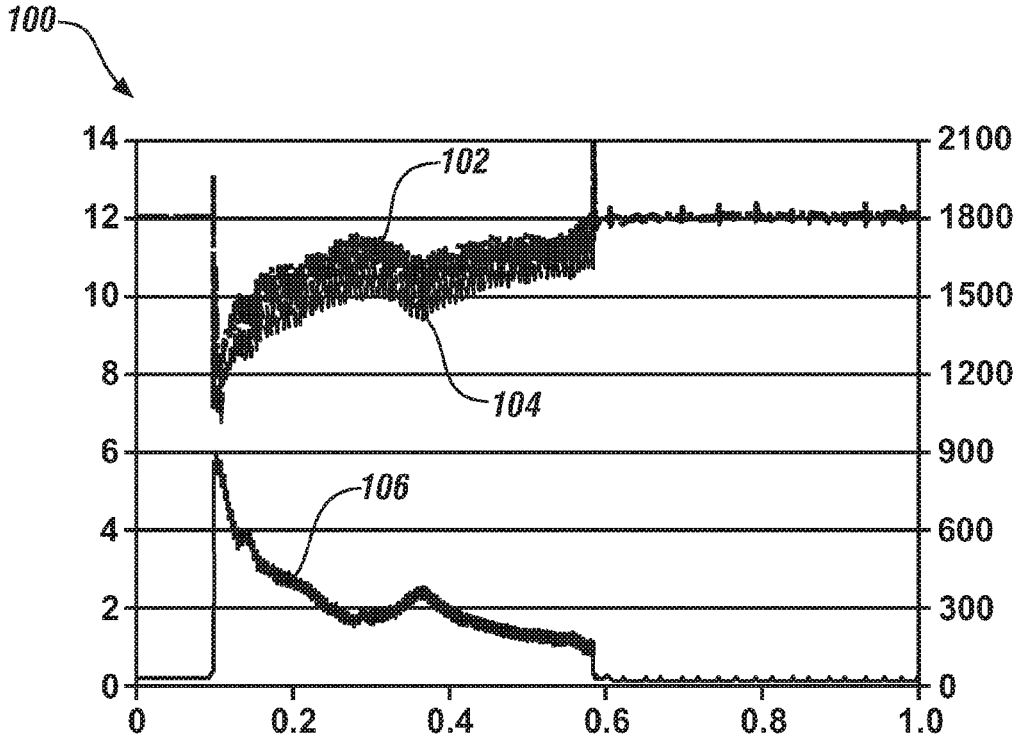
FIG. 10 illustrates an exemplary plot 100 of cranking voltage 102, load voltage 104, and current 106 during an engine cranking event without utilizing the exemplary battery isolator circuit of FIG. 2, in accordance with the present disclosure.

FIG. 10 illustrates an exemplary plot 100 of cranking voltage 102, load voltage 104, and current 106 during an engine cranking event without utilizing the exemplary battery isolator circuit of FIG. 2, in accordance with the present disclosure. It will be understood, that voltage is supplied from the primary ESD 14 during an autostart of the engine to supply energy required for cranking the engine. Accordingly, current is drawn from the primary ESD 14 during cranking of the engine.

The horizontal x-axis of plot denotes time in seconds, the left-side vertical y-axis denotes voltage in Volts, and the right-side vertical y-axis denotes current in Amps. In response to an engine cranking event at around 0.1 seconds, the cranking voltage 102 drops from about 12 Volts to about 7 Voltas and the current 106 drawn increases to about 900 Amps from zero Amps. As engine starting occurs, the cranking voltage 102 begins to increase back to about 12 Volts and the current 106 begins to decrease back to zero Amps. In contrast to plot 500 of FIG. 9, the load voltage 104 experiences a voltage drop from about 12 Volts to about 7 Volts similar to that of the cranking voltage 102. Because the starter motor 12 and the primary ESD 14 are not disconnected from the one or more auxiliary loads 16, the large voltage drop in the load voltage 104 results during the autostart event of the engine when the engine is cranked and large currents are drawn from the primary ESD 14. As aforementioned, large voltage drops in the load voltage 104 are referred to as voltage sag, and can result in diagnostic faults in the electrical system relayed to the driver, controller resets and other electrical failures such as vehicle interior lighting and accessories to being interrupted.

The disclosure has described certain preferred embodiments and modifications thereto. Further modifications and alterations may occur to others upon reading and understanding the specification. Therefore, it is intended that the disclosure not be limited to the particular embodiment(s) disclosed as the best mode contemplated for carrying out this disclosure, but that the disclosure will include all embodiments falling within the scope of the appended claims.

The invention claimed is:

1. Method for voltage stabilization during an engine starting event of a vehicle, comprising in sequence:

simultaneously establishing a first switch device of a switch device module closed to electrically couple a primary electrical energy storage device (ESD) and a contactor of a starter motor to a positive terminal of a load module managing electrical power distribution to one or more auxiliary loads, and a second switch device of the switch device module opened to electrically decouple an auxiliary ESD from the positive terminal of the load module;

receiving, at the switch device module, an active Start_ON signal from a starter solenoid module indicating initiation of the engine starting event;

establishing the second switch device of the switch device module closed to electrically couple the auxiliary ESD to the positive terminal of the load module within a predetermined delay since the active Start_ON signal was received;

establishing the first switch device of the switch device module opened to electrically decouple the primary ESD and the contactor of the starter motor from the positive terminal of the load module only after the auxiliary ESD has been electrically coupled to the positive terminal of the load module; and in response to a predetermined condition occurring while the primary ESD and the contactor of the starter motor are electrically decoupled from the positive terminal of the load module, establishing the first switch device of the switch device module closed to electrically couple the positive terminal of the load module one or more electrical loads to the primary ESD and to the contactor of the starter motor.

2. The method of claim 1, wherein establishing the second switch device of the switch device module closed within the predetermined delay comprises the predetermined delay less than a time delay associated with actuating a starter control solenoid in response to the active Start_On signal from the starter solenoid module.

3. The method of claim 1, further comprising:

subsequent to establishing the second switch device of the switch device module closed to electrically couple the auxiliary ESD to the positive terminal of the load module, establishing the second switch device of the switch device module opened to electrically decouple the auxiliary ESD from the positive terminal of the load module based upon the earlier one of the following signals received by the switch device module, comprising:

an inactive Ignition signal from an ignition module indicating a vehicle key-OFF condition; and an active Auto_Stop signal from an electro-hydraulic transmission pump module indicating initiation of an engine autostop event.

4. The method of claim 1, wherein establishing the first switch device of the switch device module opened to electrically decouple the primary ESD and the contactor of the starter motor from the positive terminal of the load module only after the auxiliary ESD has been electrically coupled to the positive terminal of the load module comprises:

establishing the first switch device of the switch device module opened to electrically decouple the primary ESD and the contactor of the starter motor from the positive terminal of the load module within a predetermined period of time since first receiving the active Start_ON signal.

5. The method of claim 1, wherein establishing the first switch device of the switch device module opened to electrically decouple the primary ESD and the contactor of the starter motor from the positive terminal of the load module only after the auxiliary ESD has been electrically coupled to the positive terminal of the load module comprises:

establishing the first switch device of the switch device module opened to electrically decouple the primary ESD and the contactor of the starter motor from the positive terminal of the load module when a monitored cranking voltage at the primary ESD drops by a predetermined magnitude of voltage below a monitored voltage of the auxiliary ESD.

6. The method of claim 1, wherein the predetermined condition comprises a monitored voltage of the primary ESD exceeding a monitored voltage of the one or more auxiliary loads by a predetermined magnitude.

7. The method of claim 1, wherein the predetermined condition comprises a predetermined period of time elapsing from when the Start_ON signal was first received at the switch device module.

8. The method of claim 1, wherein the predetermined condition comprises the switch device module receiving an inactive Start_ON signal from the starter solenoid module indicating completion of the engine starting event.

9. The method of claim 1, further comprising:

monitoring, at the switch device module, a voltage of the primary ESD and a voltage of the one or more auxiliary loads;

receiving, at the switch device module, an active Ignition signal indicating a vehicle key-ON condition; and wherein the first switch device is established opened when the voltage of the primary ESD is less than the voltage of the one or more auxiliary loads by a predetermined magnitude and only after the auxiliary ESD has been electrically coupled to the positive terminal of the load module.

10. The method of claim 1, wherein the engine starting event comprises either one of a key-on engine starting event and an engine autostart event.

11. Apparatus for stabilizing voltage during an engine starting event of a vehicle, comprising:

a first switch device electrically coupling a contactor of a starter motor and a primary electrical energy storage device (ESD) to a positive terminal of a load module managing electrical power distribution to one or more auxiliary loads of the vehicle only when closed;

a second switch device electrically coupling an auxiliary ESD to the positive terminal of the load module only when closed;

a controller executing the following steps, comprising in sequence:

during an active Ignition signal from an ignition module indicating a vehicle key-ON condition, receiving an active Start_ON signal from a starter solenoid module indicating initiation of the engine starting event;

closing the second switch device within a predetermined delay since the active Start_ON signal was received to electrically couple the auxiliary ESD to the positive terminal of the load module; and subsequent to closing the second switch device, opening the first switch device to electrically decouple the contactor of the starter motor and the primary ESD from the positive terminal of the load module.

12. The apparatus of claim 11, wherein the controller further executes the following step, comprising:

in response to one or more predetermined conditions occurring while the first switch device is open and the second switch device is closed, closing the first switch device to electrically couple the primary ESD and the contactor of the starter motor to the positive terminal of the load module.

13. The apparatus of claim 12, wherein the one or more predetermined conditions comprise:

a monitored voltage of the primary ESD exceeding a monitored voltage of the one or more auxiliary loads by a predetermined magnitude;

a second predetermined period of time elapsing from when the Start_ON signal was first received by the controller; and an inactive Start_ON signal from the starter solenoid module received by the controller indicating completion of the engine starting event.

14. The apparatus of claim 11, wherein the controller further executes the following step, comprising:

in response to receiving an inactive Ignition signal from the ignition module indicating a vehicle key-OFF condition while the second switch device is closed, opening the second switch device to electrically decouple the auxiliary ESD from the positive terminal of the load module.

15. The apparatus of claim 11, wherein the controller further executes the following step, comprising:

in response to receiving an active Auto_Stop signal provided from an electro-hydraulic transmission pump module indicating initiation of an engine autostop event while the second switch device is closed, opening the second switch device to electrically decouple the auxiliary ESD from the positive terminal of the load module.

16. The apparatus of claim 15, wherein the electro-hydraulic transmission pump module provides the active Auto_Stop signal when an electric motor driven pump configured to supply pressurized hydraulic fluid to a transmission of the vehicle is to be turned on when the engine is off.

17. The apparatus of claim 11, wherein the controller further executes the following steps, comprising:

receiving an inactive Start_ON signal indicating completion of the engine starting event while the second switch device is closed; and only after a predetermined period of time has elapsed since the inactive Start_ON signal was received, opening the second switch device.

18. The apparatus of claim 11, wherein opening the first switch device to electrically decouple the contactor of the starter motor and the primary ESD from the positive terminal of the load module comprises opening the first switch device within a predetermined period of time since the active Start_ON signal was received by the controller when a monitored cranking voltage at the primary ESD drops by a predetermined magnitude below a monitored voltage of the auxiliary ESD.

19. The apparatus of claim 11, wherein the primary ESD provides electrical energy to a starter motor for cranking the engine during the engine starting event.

* * * * *